US008400394B2

(12) United States Patent
Lee et al.

(10) Patent No.: US 8,400,394 B2
(45) Date of Patent: Mar. 19, 2013

(54) BACKLIGHT UNIT ASSEMBLY, LIQUID CRYSTAL DISPLAY HAVING THE SAME, AND DIMMING METHOD THEREOF

(75) Inventors: Young-Keun Lee, Cheonan-si (KR); Gi-Cheri Kim, Yongin-si (KR); Byung-Choon Yang, Incheon (KR); Jeom-Oh Kim, Jeonbuk (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 1161 days.

(21) Appl. No.: 12/266,323

(22) Filed: Nov. 6, 2008

(65) Prior Publication Data

US 2009/0243982 A1 Oct. 1, 2009

(30) Foreign Application Priority Data

Apr. 1, 2008 (KR) ..... 10-2008-0030427

(51) Int. Cl.
*G09G 3/36* (2006.01)

(52) U.S. Cl. ..... 345/102; 345/89; 345/690

(58) Field of Classification Search ..... 345/87–89, 345/102, 690
See application file for complete search history.

(56) References Cited

U.S. PATENT DOCUMENTS

| | | | | |
|---|---|---|---|---|
| 2003/0090455 | A1* | 5/2003 | Daly | 345/102 |
| 2005/0104841 | A1* | 5/2005 | Sohn et al. | 345/102 |
| 2006/0007104 | A1* | 1/2006 | Hong | 345/102 |
| 2006/0146005 | A1* | 7/2006 | Baba et al. | 345/102 |
| 2006/0164379 | A1* | 7/2006 | Oh et al. | 345/102 |
| 2006/0208999 | A1* | 9/2006 | Lee et al. | 345/102 |
| 2007/0052662 | A1* | 3/2007 | Kim et al. | 345/102 |
| 2007/0152949 | A1* | 7/2007 | Sakai | 345/102 |

FOREIGN PATENT DOCUMENTS

| | | |
|---|---|---|
| JP | 2006-145798 | 6/2006 |
| JP | 2007-034251 | 2/2007 |
| KR | 1020070070915 | 7/2007 |

OTHER PUBLICATIONS

English Abstract for Publication No. 2006-145798.
English Abstract for Publication No. 2007-034251.
English Abstract for Publication No. 1020070070915.

* cited by examiner

*Primary Examiner* — Amare Mengistu
*Assistant Examiner* — Koosha Sharifi-Tafreshi
(74) *Attorney, Agent, or Firm* — F. Chau & Associates, LLC

(57) ABSTRACT

A backlight unit assembly, a liquid crystal display having the same, and a dimming method thereof are provided. The dimming method for a liquid crystal display includes setting a plurality of lookup tables, each lookup table having different data for adjusting luminance corresponding to a same grayscale, calculating a grayscale average of a whole liquid crystal display panel and grayscale averages of individual liquid crystal display panel blocks with respect to an image signal input to the liquid crystal display panel, selecting one of the plurality of lookup tables in accordance with the whole grayscale average, and calculating the data for obtaining the luminance corresponding to the individual grayscale averages in the selected lookup table, and adjusting and applying power to a light emitting diode assembly using the calculated data. In the case of displaying an image, which is dark on the whole and only a part of which is bright, power is applied with a wider pulse width at the same grayscale, and thus the image can be displayed with a desired luminance to minimize image distortion.

19 Claims, 8 Drawing Sheets

BACKLIGHT UNIT ASSEMBLY, LIQUID CRYSTAL DISPLAY HAVING THE SAME, AND DIMMING METHOD THEREOF

CROSS-REFERENCE TO RELATED APPLICATION

This application is based on and claims priority from Korean Patent Application No. 10-2008-0030427, filed on Apr. 1, 2008, in the Korean Intellectual Property Office, the contents of which are herein incorporated by reference in their entirety.

BACKGROUND OF THE INVENTION

1. Field of the Invention

The present disclosure is directed to a backlight unit assembly, a liquid crystal display having the same, and a dimming method thereof, and more particularly to a backlight unit assembly, a liquid crystal display having the same, and a dimming method thereof, which can minimize image distortion by setting a plurality of lookup tables having different pulse width data in accordance with grayscale classes and performing dimming by using different lookup tables in accordance with the grayscale classes of an image signal for each frame of an image.

2. Description of the Prior Art

Flat panel displays, such as liquid crystal displays (LCD), plasma display panels (PDP), or the like, have been replacing cathode ray tubes (CRT) in computer display monitors. However, since the liquid crystal display is not a self-illuminating device, separate light sources are required. Accordingly, the liquid crystal display is provided with a backlight unit installed in a lower part of a liquid crystal display panel, which displays an image using light emitted from the backlight unit. A light emitting diode (LED) has recently been spotlighted as a light source of such a backlight unit.

A backlight unit using light emitting diodes as light sources can perform local dimming to improve contrast ratio and reduce power consumption. Generally, the local dimming is performed such that a grayscale average of the image data of pixels corresponding to one block of a liquid crystal display panel is calculated, and an adjusted power is applied to a light emitting diode block corresponding to the one block of the liquid crystal display panel to obtain a luminance corresponding to the calculated grayscale average.

Here, pulse widths for obtaining the luminance corresponding to the respective grayscales are measured in advance and stored in a memory in the form of lookup tables. For each frame of an image, the pulse widths are adjusted with reference to the lookup tables, and then the adjusted pulse signal is applied to the backlight unit to adjust the luminance. Generally, the lookup table is set by setting the grayscale values of the pixels of the whole liquid crystal display panel to the range 0~255, adjusting the pulse widths where the luminance is adjusted corresponding to the grayscale values, and then providing corresponding pulse width data.

As described above, according to a conventional liquid crystal display, the local dimming is performed using one fixed lookup table. For local dimming with reference to the lookup tables set as above, light leakage of liquid crystals can be effectively prevented in a dark part of the image.

However, in performing local dimming using one lookup table, if the image is dark on the whole, and only a part thereof is bright, the light intensity of the bright part can cause image distortion. Specifically, when an image, which is bright on the whole but which has specified blocks that are relatively dark, is displayed, the luminance of the specified dark blocks is affected by neighboring bright blocks. However, in the case of displaying an image, which is dark on the whole, but which has specified blocks that are relatively bright, the luminance of the specified bright blocks is not affected by the neighboring dark blocks, and thus their luminance may be reduced.

SUMMARY OF THE INVENTION

Embodiments of the present invention provide a backlight unit assembly, a liquid crystal display having the same, and a dimming method thereof, which can minimize image distortion by setting a plurality of lookup tables having different pulse width data for obtaining luminance corresponding to a same grayscale, and performing dimming with reference to the lookup tables corresponding to grayscale classes in accordance with the whole grayscale of an image for each frame.

Further embodiments of the present invention provide a backlight unit assembly, a liquid crystal display having the same, and a dimming method thereof, in which a liquid crystal display panel is divided into a plurality of blocks, grayscales of a small number of blocks selected for the respective grayscale classes are changed, and pulse width data for adjusting luminance according to the changed grayscales are set in the form of a plurality of lookup tables.

Additional features of embodiments of the invention will be set forth in part in the description which follows and in part will become apparent to those having ordinary skill in the art upon examination of the following or may be learned from practice of the invention.

According to an aspect of the invention, there is provided a backlight unit assembly which includes a light emitting diode assembly including a plurality of light emitting diode blocks; and a backlight unit driving unit for calculating a whole grayscale average and a plurality of individual grayscale averages from an image signal, selecting one of a plurality of lookup tables, each said lookup table having different data for adjusting luminance corresponding to a same grayscale in accordance with the whole grayscale average, and adjusting luminance of the light emitting diode blocks in accordance with the data corresponding to the individual grayscale averages in the selected lookup table.

The individual grayscale averages may be obtained by dividing the image signal into blocks corresponding to the light emitting diode blocks, and calculating the grayscale averages of the individual image signal blocks.

The backlight unit driving unit may include a memory for storing the plurality of lookup tables; a luminance control unit for calculating the whole grayscale average and the plurality of individual grayscale averages from the image signal, selecting any one of the plurality of lookup tables in accordance with the whole grayscale average, and calculating the data for obtaining the luminance corresponding to the individual grayscale averages in the selected lookup table; and a dimming control unit for controlling the luminance of the light emitting diode blocks in accordance with the data calculated by the luminance control unit.

The plurality of lookup tables may be constructed in accordance with grayscale classes, and the respective lookup tables store the data for adjusting the luminance corresponding to grayscale changes in the respective grayscale classes.

The data may be pulse width data for adjusting the luminance of the light emitting diode blocks.

The backlight unit driving unit may include a field-programmable gate array (FPGA), and the FPGA includes the luminance control unit and the dimming control unit.

The backlight unit driving unit may further include a color control unit for determining representative colors of the light emitting diode blocks.

The memory may include a plurality of color lookup tables for a plurality of color classes including color grayscales having similar visibilities; and a color coordinate lookup table including a plurality of color regions having similar visibilities in a color coordinate system.

The color control unit may select as a representative color a color region onto which most color classes of the image signal are mapped, and may select the representative color as the color of the light emitting diode block region.

In another aspect of the present invention, there is provided a liquid crystal display, which includes a liquid crystal display panel for displaying an image; a liquid crystal display panel driving unit for driving the liquid crystal display panel; a light emitting diode assembly including a plurality of light emitting diode blocks for providing light to the liquid crystal display panel; and a backlight unit driving unit for calculating a whole grayscale average and a plurality of individual grayscale averages from an image signal input to the liquid crystal display panel, selecting one of a plurality of lookup tables, each said lookup table having different data for adjusting luminance corresponding to a same grayscale in accordance with the whole grayscale average, and adjusting luminance of the light emitting diode blocks in accordance with the data corresponding to the individual grayscale averages in the selected lookup table.

The liquid crystal display panel may include a plurality of liquid crystal display panel blocks.

The light emitting diode blocks may be provided in positions corresponding to the liquid crystal display panel blocks, respectively.

The liquid crystal display panel blocks may be divided into selected blocks and non-selected blocks. The lookup tables may be provided with the data for classifying the plurality of liquid crystal display panel blocks into a plurality of grayscale classes in accordance with grayscales of the non-selected blocks, changing grayscales of the selected blocks for the respective grayscale classes, and obtaining the luminance corresponding to the changed grayscales.

The backlight unit driving unit may include a memory for storing the plurality of lookup tables that set the data for classifying the plurality of liquid crystal display panel blocks into a plurality of grayscale classes in accordance with grayscales of the non-selected blocks among the liquid crystal display panel blocks, changing grayscales of the selected blocks for the respective grayscale classes, and obtaining the luminance corresponding to the changed grayscales; a luminance control unit for calculating the whole grayscale average and the plurality of individual grayscale averages from the image signal, selecting any one of the plurality of lookup tables in accordance with the whole grayscale average, and calculating the data for adjusting the luminance corresponding to the individual grayscale averages in the selected lookup table; and a dimming control unit for controlling the luminance of the light emitting diode blocks in accordance with the data calculated by the luminance control unit.

The backlight unit driving unit may further include a color control unit for selecting representative colors of the light emitting diode blocks.

The memory may include a plurality of color lookup tables having a plurality of color classes including color grayscales having similar visibilities; and a color coordinate lookup table including a plurality of color regions having similar visibilities in a color coordinate system.

In still another aspect of the present invention, there is provided a dimming method for a liquid crystal display, which includes setting a plurality of lookup tables having different data for obtaining luminance corresponding to a same grayscale; calculating a grayscale average of a whole liquid crystal display panel and grayscale averages of individual liquid crystal display panel blocks with respect to an image signal input to the liquid crystal display panel; selecting one of the plurality of lookup tables in accordance with the whole grayscale average, and calculating the data for obtaining the luminance corresponding to the individual grayscale averages in the selected lookup table; and adjusting and applying a power to a light emitting diode assembly using the calculated data.

Setting a plurality of lookup tables may include dividing the liquid crystal display panel blocks into selected blocks and non-selected blocks, classifying the liquid crystal display panel blocks into a plurality of grayscale classes in accordance with grayscales of the non-selected blocks; and changing grayscales of the selected blocks for the respective grayscale classes, and setting the data for obtaining the luminance corresponding to the changed grayscales.

The dimming method may further include classifying pixels of the respective liquid crystal display panel blocks into color classes; selecting representative colors of the color classes; and adjusting colors of the light emitting diode blocks in accordance with the representative colors.

Classifying pixels may include setting color lookup tables; extracting image signals of the respective pixel data of the liquid crystal display panel blocks; and classifying the respective pixels of the liquid crystal display panel blocks into the color classes by comparing the image signals with the color lookup tables.

Setting color lookup tables may include dividing red, green, and blue into specified color grayscales; assigning similar color grayscales among the color grayscales into identical color classes; and arranging the color classes into tables.

It is to be understood that both the foregoing general description and the following detailed description are exemplary and explanatory and are intended to provide further explanation of the invention as claimed.

DETAILED DESCRIPTION OF EXEMPLARY EMBODIMENTS

Figure 1:
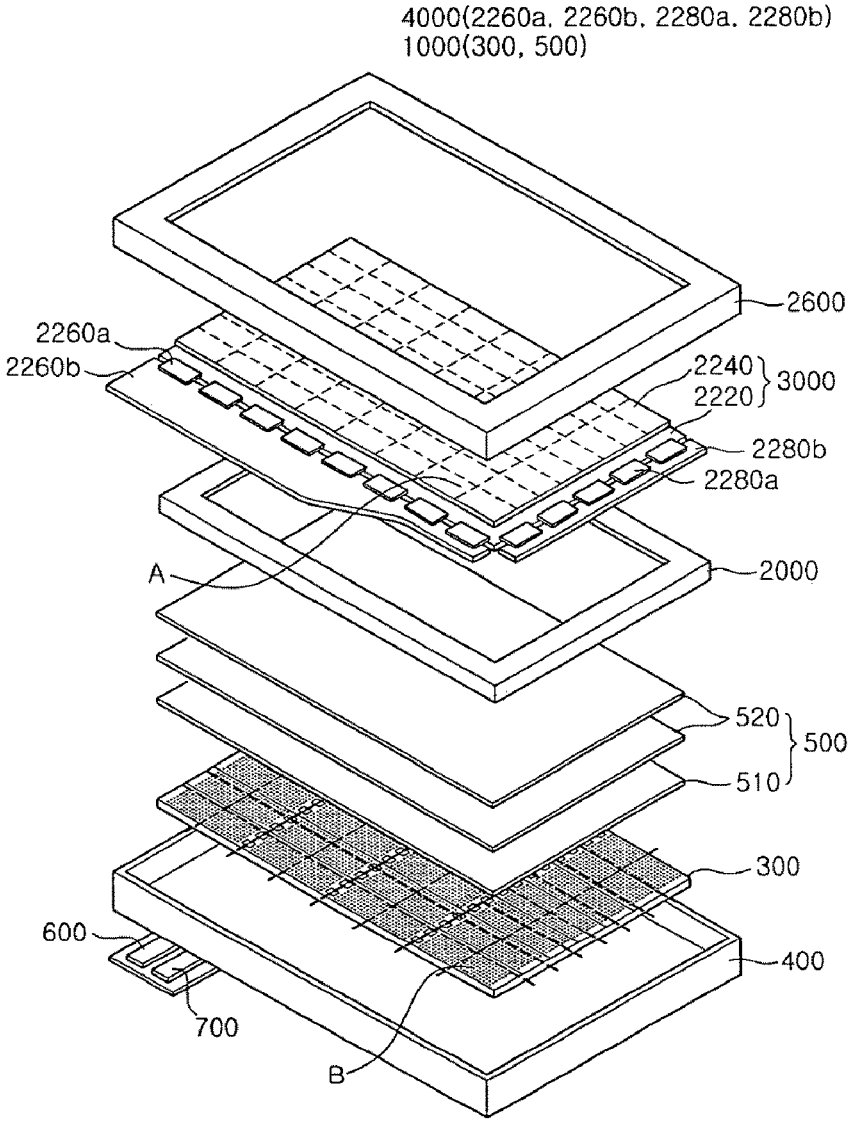
FIG. 1 is an exploded perspective view schematically illustrating a liquid crystal display according to an embodiment of the present invention.

Hereinafter, exemplary embodiments of the present invention will be described in detail with reference to the accompanying drawings. However, the present invention is not limited to the embodiments disclosed hereinafter, but can be implemented in diverse forms. In the drawings, the thickness of such layers and areas are enlarged, and the same drawing reference numerals are used for the same elements across various figures. The term "on" includes both a case where an element is located directly on another element or a layer and a case where an element is located on another element via another layer or still another element.

Figure 2:
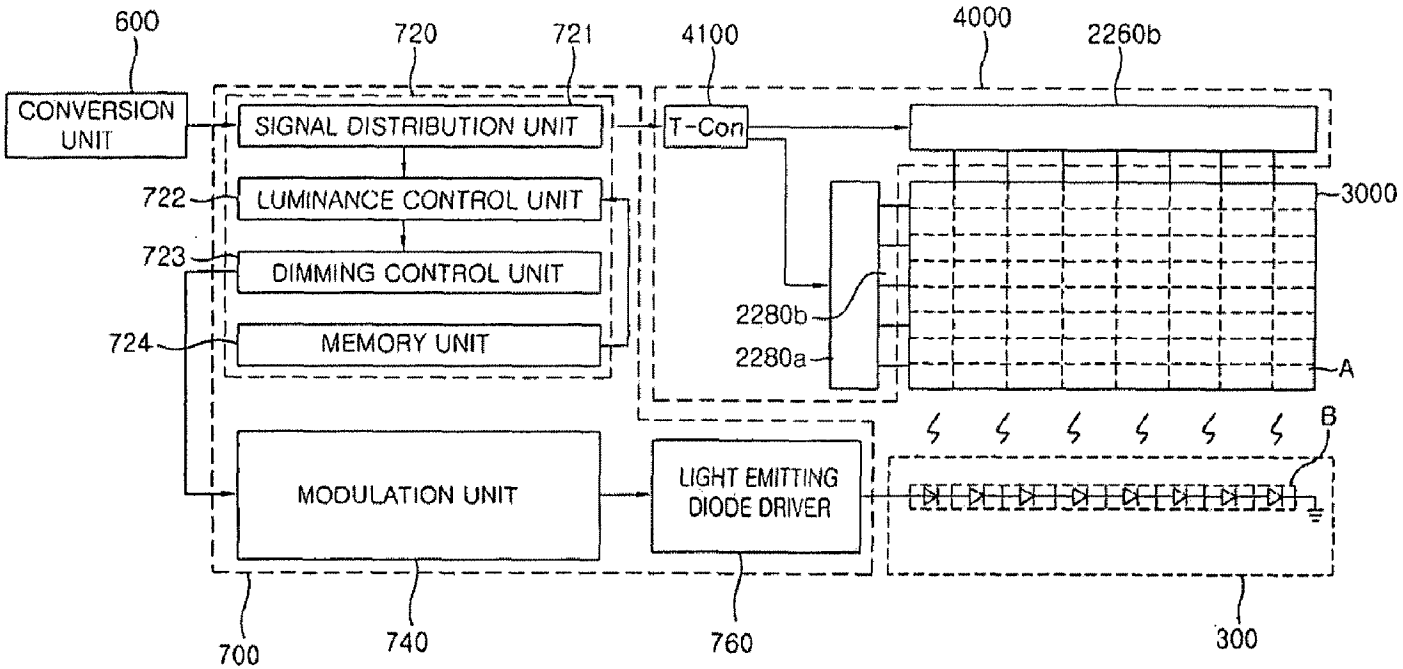
FIG. 2 is a conceptual view of a liquid crystal display according to an embodiment of the present invention.
Figure 3:
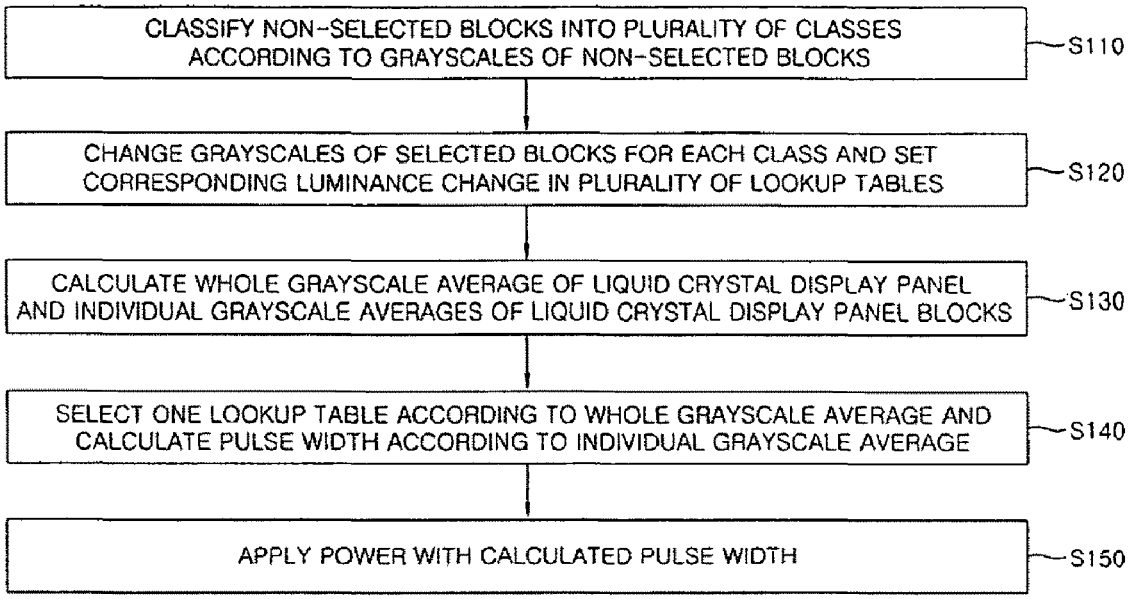
FIG. 3 is a flowchart illustrating a dimming method for a liquid crystal display according to an embodiment of the present invention.

FIG. 1 is an exploded perspective view schematically illustrating a liquid crystal display according to an embodiment of the present invention, and FIG. 2 is a conceptual view of a liquid crystal display according to an embodiment of the present invention. FIG. 3 is a flowchart illustrating a dimming method for a liquid crystal display according to an embodiment of the present invention.

Referring to FIGS. 1 and 2, a liquid crystal display according to an embodiment of the present invention includes a liquid crystal display panel assembly having a liquid crystal display panel 3000 and a liquid crystal display panel driving unit 4000 driving the liquid crystal display panel, and a backlight unit assembly having a backlight unit 1000 supplying light to the liquid crystal display panel 3000 and a backlight unit driving unit 700 driving the liquid crystal display panel. The liquid crystal display according to an embodiment of the present invention also includes upper and lower receiving members 2600 and 400 for receiving and protecting the liquid crystal panel assembly and the backlight unit assembly, respectively. The liquid crystal display panel 3000 is provided with a specified number of data lines and gate lines, and is divided into a plurality of liquid crystal display panel blocks A, which are virtual block regions of a specified size in the form of a matrix. Also, a light emitting diode assembly 300 of the backlight unit 1000 is divided into a plurality of light emitting diode blocks B corresponding to the plurality of liquid crystal display panel blocks A.

The liquid crystal display panel assembly includes the liquid crystal display panel 3000 composed of a thin film transistor substrate 2220, a color filter substrate 2240 corresponding to the thin film transistor substrate 2220, and a liquid crystal layer (not illustrated) interposed between the thin film transistor substrate 2220 and the color filter substrate 2240; and a liquid crystal display panel driving unit 4000 driving the liquid crystal display panel 3000. The liquid crystal display panel 3000 may further include a polarizing plate (not illustrated) formed to correspond to an upper part of the color filter substrate 2240 and a lower part of the thin film transistor substrate 2220.

The thin film transistor substrate 2220 is a transparent substrate which includes gate lines, data lines, thin film transistors (TFT) formed on a region where the gate lines and the data lines cross each other, and pixel electrodes. The thin film transistor has a gate terminal, a source terminal, and a drain terminal. The gate terminal of the thin film transistor is connected to the gate line, the source terminal is connected to the data line, and the drain electrode is connected to the pixel electrode. If an electric signal is input to the gate lines and the data lines, the respective thin film transistors are turned on/off, and signals required to form pixels are applied to the drain terminals of the thin film transistors, where an image is displayed on the liquid crystal display panel.

The color filter substrate 2240 is a substrate on which color pixels of red (R), green (G), and blue (B) are formed. These color pixels produce specified colors as light passes through the color filter substrate. In addition, common electrodes (not illustrated) made of a transparent conductor, such as indium tin oxide (ITO) or indium zinc oxide (IZO), are formed on the whole surface of the color filter substrate 2240.

The liquid crystal display panel driving unit 4000 includes data-side and gate-side tape carrier packages (TCP) 2260*a* and 2280*a* connected to the thin film transistor substrate 2220, and data-side and gate-side printed circuit boards 2260*b* and 2280*b* connected to the data-side and gate-side tape carrier packages (TCP) 2260*a* and 2280*a*, respectively, that drive the liquid crystal display panel 3000.

The backlight unit assembly includes the backlight unit 1000 and the backlight unit driving unit 700, and supplies light to the liquid crystal display panel 3000. The backlight unit 1000 includes the light emitting diode assembly 300 provided with a plurality of light emitting diodes, and optical sheets 500 for improving the quality of light emitted from the light emitting diodes. The backlight unit 100 may further include a mold frame 2000 for fixing the light emitting diode assembly 300 and the optical sheets 500. The light emitting diodes are packaged at predetermined intervals in horizontal and vertical directions on the substrate. The light emitting diode may include a light emitting chip in which a compound semiconductor having a p-n junction structure is laminated to emit light due to the recombination of minority carriers (electrons or holes), a base member packaging the light emitting chip, and a molding part molding the light emitting chip. Also, a fluorescent material may be applied to the molding part of a blue light emitting diode where the light emitting diode emits white light. In addition, blue, green, and red light emitting diodes may be combined to emit white light.

The optical sheets 500 include a diffusion sheet 510 and prism sheets 520 to improve the quality and efficiency of light emitted from the light emitting diode block assembly 200. The diffusion sheet 510, which is positioned on an upper surface of the light emitting diode assembly 300, uniformly diffuses the light emitted from the plurality of light emitting diodes, from which the uniformly diffused light propagates in a direction of a front surface of the prism sheets 520 and the liquid crystal display panel 3000 to widen the viewing angle. The diffusion sheet 510 also reduces the diffusion of bright defects, bright lines, spots, and the like. The diffusion sheet 510 may be manufactured using polycarbonate (PC) resin or polyester (PET) resin. The prism sheets 520 increase the luminance of the light emitted from the diffusion sheet 510 by refracting and condensing the light, and the resultant light is incident to the liquid crystal display panel. The prism sheets 520, which may be a set of horizontal and vertical prism sheets, are prepared by forming a belt-shaped micro-prism on an upper part of a base material such as polyester (PET).

Referring now to FIG. 2, the backlight unit driving unit 700 adjusts the power for driving the light emitting diodes provided in the light emitting diode assembly 300, and includes a field-programmable gate array (FPGA) 720, a modulation unit 740, a light emitting diode driver 760, and a power supply unit (not illustrated). The FPGA 720 stores a plurality of lookup tables, receives an image signal applied from an external video card through a conversion unit 600, and calculates a luminance average of the image signal to output a signal for adjusting the driving power of the light emitting diodes. The modulation unit 740 and the light emitting diode driver 760 adjust the driving power of the light emitting diodes in accordance with the signal outputted from the FPGA 720.

The FPGA 720 includes a signal distribution unit 721, a luminance control unit 722, a dimming control unit 723, and a memory unit 724. In the memory unit 724, a plurality of lookup tables are stored. The plurality of lookup tables are set in a manner that the remaining blocks (hereinafter referred to as "non-selected blocks") of the plurality of liquid crystal display panel blocks A, except for the selected blocks (hereinafter referred to as "selected blocks"), are classified into a plurality of grayscale classes, where grayscales of the selected blocks for the respective grayscale classes have grayscale values in the range 0~255. Pulse width data applied to the light emitting diode assembly 300 are calculated where the luminance is adjusted corresponding to the grayscales of the selected blocks in accordance with the respective grayscale classes. The signal distribution unit 721 receives the image signal through the conversion unit 600, controls and applies the grayscale data of the image signal and the timing of the image signal to the timing controller 4100 of the liquid crystal display panel driving unit 4000 and the luminance control unit 722. The luminance control unit 722 receives the grayscale data of the image signal from the signal distribution unit 721, and using the received grayscale data, calculates the grayscale average of the whole liquid crystal display panel 3000 and the grayscale averages of individual liquid crystal display panel blocks A. Also, the luminance control unit 722 selects from the plurality of lookup tables the lookup table of the class corresponding to the whole grayscale average, and calculates pulse widths using the selected lookup table for setting the luminance of the liquid crystal display panel blocks A that suit the individual grayscale averages. The luminance control unit 722 generates and supplies a luminance control signal including the calculated pulse width information to the dimming control unit 723. The dimming control unit 723 outputs a dimming control signal for adjusting the power being supplied to the light emitting diode blocks B of the light emitting diode assembly 300 in accordance with the luminance control signal input from the luminance control unit 722. On the other hand, the power supply unit (not illustrated) supplies the power to the modulation unit 740, and includes a linear power supply or a switch mode power supply. The modulation unit 740 adjusts the pulse width of the power being applied from the power supply unit to adjust the luminance of the light emitting diode blocks B in accordance with the dimming control signal, and applies the adjusted signal to the light emitting diode driver 760. The light emitting diode driver 760 stably drives the light emitting diode block region B in accordance with the applied signal.

On the other hand, in an embodiment of the present invention, the timing controller 4100 for controlling the timing of the image signal being applied to a source driver and a gate driver of the liquid crystal display panel 3000 is separately provided. However, the timing controller may be built in the FPGA 720. Also, The FPGA 720 may be packaged on the substrate in the form of an integrated circuit (IC).

A dimming method using a plurality of lookup tables of a liquid crystal display as configured above according to an embodiment of the present invention will now be described with reference to FIG. 3.

Referring to FIG. 3, a dimming method according to an embodiment of the present invention includes setting the grayscales of the non-selected blocks A2 of the liquid crystal display panel blocks A, and classifying the non-selected blocks A2 into a plurality of grayscale classes in accordance with the grayscale values of the non-selected blocks A2 at step S110. At step S120; the grayscales of the selected blocks A1 are set for the respective grayscale classes, the pulse width data being applied to the light emitting diode assembly 300 are set and stored in a plurality of lookup tables to obtain the luminance corresponding to the grayscales of the selected blocks A1. At step S130, the grayscale average of the whole liquid crystal display panel 300 of the image signal and the grayscale averages of the individual liquid crystal display panel blocks A are calculated. A method according to an embodiment of the present invention further includes, at step S140, selecting from the plurality of lookup tables the lookup table of the grayscale class corresponding to the grayscale average of the whole liquid crystal display panel 3000, and calculating the pulse width data for obtaining the luminance corresponding to the grayscale averages of the individual liquid crystal display panel blocks A in the selected lookup table. At step S150, the power being applied from the light emitting diode driving unit 700 to the light emitting diode assembly 300 is adjusted using the calculated pulse width data.

Figure 4:
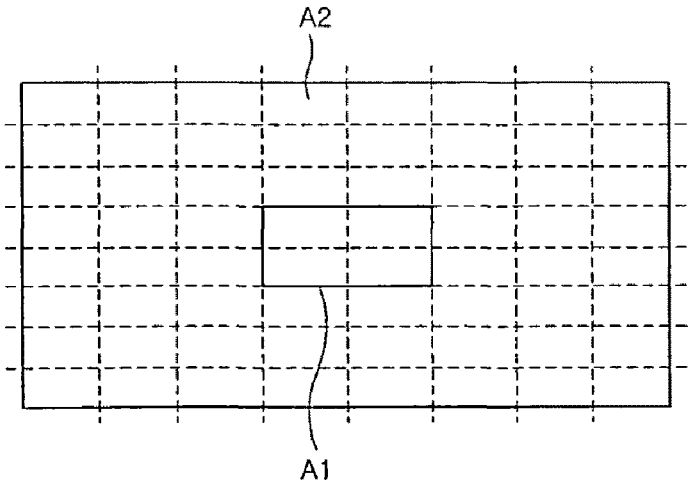
FIG. 4 is a conceptual view of a plurality of liquid crystal display panel blocks that comprise a liquid crystal display panel according to an embodiment of the present invention.

S110: As illustrated in FIG. 4, a plurality of liquid crystal display panel blocks A are defined by dividing the liquid crystal display panel 1000 into a plurality of virtual regions. Also, the light emitting diode assembly 300 is divided into a plurality of light emitting diode blocks B corresponding to the plurality of liquid crystal display panel blocks A. The liquid crystal display panel blocks A can be, for example, subdivided into a selected block A1 of four blocks positioned in the center of liquid crystal display panel blocks A, and non-selected blocks A2 surrounding the selected blocks A1. Then, the grayscales of non-selected blocks A2 are changed. The grayscales of the non-selected blocks A2 are set to one of five grayscale class values 50, 100, 150, 200, and 255. To adjust the luminance of the non-selected blocks A2 corresponding to the grayscales of the five classes, the power being supplied to the light emitting diode assembly 300 is adjusted. Note that the five classes described above are exemplary and non-limiting, and the gray scales may be classified into at least two classes, and up to maximum of 256 classes with grayscale values in the range of 0~255. Here, for convenience in explanation, the class corresponding to the grayscale value 50 is called a first class, the class corresponding to the grayscale value of 100 is called a second class, the class corresponding to the grayscale value of 150 is called a third class, the class corresponding to the grayscale value of 200 is called a fourth class, and the class corresponding to the grayscale value of 255 is called a fifth class. Also, grayscales below the grayscale value of one of the first to fifth classes are included in the corresponding class in which the corresponding grayscale is included. That is, grayscale values 0~50 are included in the first class, grayscale values 51~100 are included in the second class, grayscale values 101~150 are included in the third class, grayscale values 151~200 are included in the fourth class, and grayscale values 201~255 are included in the fifth class.

Figure 5:
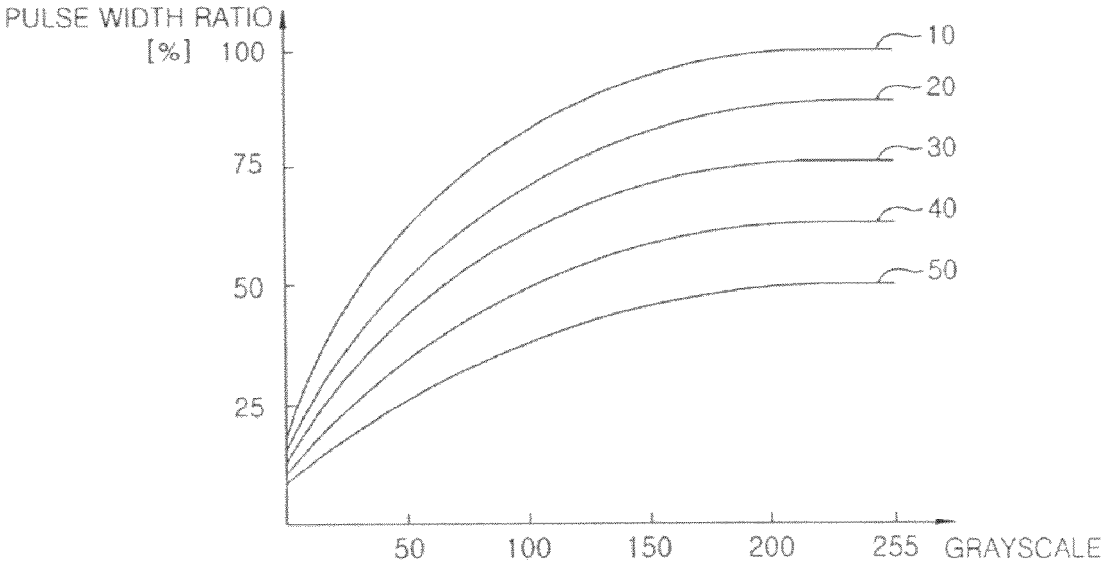
FIG. 5 is a graph illustrating relations between grayscales according to a plurality of lookup tables and pulse widths according to an embodiment of the present invention.

S120: After the non-selected blocks A2 are classified into the plurality of classes, for example, the five classes as described above, the grayscales values of the selected blocks A1 are changed in the grayscale range for each class, and the pulse width of the power being applied to the light emitting diode assembly 300 is adjusted to adjust the luminance of the selected blocks A1 corresponding to the grayscale change. The pulse width data adjusted as above are stored in the memory in the form of lookup tables. Accordingly, a plurality of lookup tables are set in accordance with the plurality of classes. That is, the first lookup table according to the first class, the second lookup table according to the second class, the third lookup table according to the third class, the fourth lookup table according to the fourth class, and the fifth lookup table according to the fifth class are stored in the memory. The plurality of lookup tables have different pulse widths being applied to the light emitting diode blocks B of the light emitting diode assembly 300 to obtain the luminance corresponding to the same grayscale. That is, as shown in FIG. 5 illustrating a graph explaining relations between the grayscales according to the lookup tables and the pulse widths, to obtain the luminance corresponding to the same grayscale, the first lookup table 10 has a larger pulse width than the second lookup table 20, the second lookup table 20 has a larger pulse width than the third lookup table 30, the third lookup table 30 has a larger pulse width than the fourth lookup table 40, and the fourth lookup table 40 has a larger pulse width than the fifth lookup table 50. For example, the pulse width for the grayscale value 255 of the first lookup table 10 may be 100, and the pulse width for the grayscale value 255 of the fifth lookup table 50 may be 50. That is, the pulse width for obtaining the luminance corresponding to the same grayscale in a low grayscale class is larger than the pulse width in a high grayscale class. As described above, the lookup tables having different pulse widths for obtaining the luminance corresponding to the same grayscale are stored in the memory unit 724.

S130: After the plurality of lookup tables are stored in the memory unit 724, the signal distribution unit 721 receives the image signal input through the conversion unit 600, extracts grayscale data of the image signal, and applies the extracted grayscale data to the luminance control unit 722. The luminance control unit 722 calculates the grayscale average of the whole liquid crystal display panel 3000 and the grayscale averages of the individual liquid crystal display panel blocks A using the grayscale data of the image signal input through the signal distribution unit 721. To calculate the grayscale average of the whole display, the luminance control unit 722 sums the grayscale intensities of the respective pixels in the image signal for the all pixels of the liquid crystal display panel 300, and divides the summed grayscale intensities by the total number of pixels of the liquid crystal display panel 3000. Also, to calculate the individual grayscale averages, the luminance control unit 722 sums the grayscale intensities of the respective pixels in the image signal corresponding to the liquid crystal display panel blocks A, and divides the summed grayscale intensities by the number of respective pixels in each of the liquid crystal display panel blocks A.

S140: The luminance control unit 722 selects from the plurality of lookup tables the lookup table corresponding to the grayscale class of the grayscale average of the whole liquid crystal display panel 3000, and calculates the pulse width data being applied to the light emitting diode assembly 300 to obtain the luminance corresponding to the individual grayscale averages of the respective liquid crystal display panel blocks A in the selected lookup table. Then, the luminance control unit 722 generates and applies a luminance control signal including the pulse width information to the dimming control unit 723.

S150: The dimming control unit 723 outputs a dimming control signal for adjusting the power of the light emitting diode blocks B of the light emitting diode assembly 300 in accordance with the luminance control signal input from the luminance control unit 722. In accordance with the dimming control signal, the modulation unit 740 and the light emitting diode driver 760 adjust the pulse width of the power being supplied from the power supply unit, and respectively apply the adjusted power to the light emitting diode blocks B of the light emitting diode block assembly 300. Accordingly, the luminance dimming is performed.

Figure 6A:
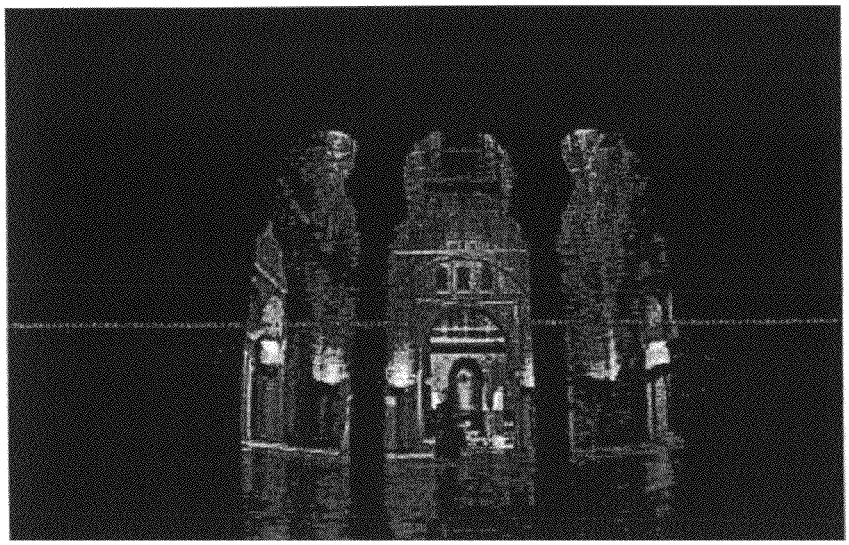
FIGS. 6A and 6B are views illustrating luminance changes in an image, which is dark on the whole and only a part of which is bright, according to a conventional dimming method and a dimming method according to the present invention.
Figure 6B:
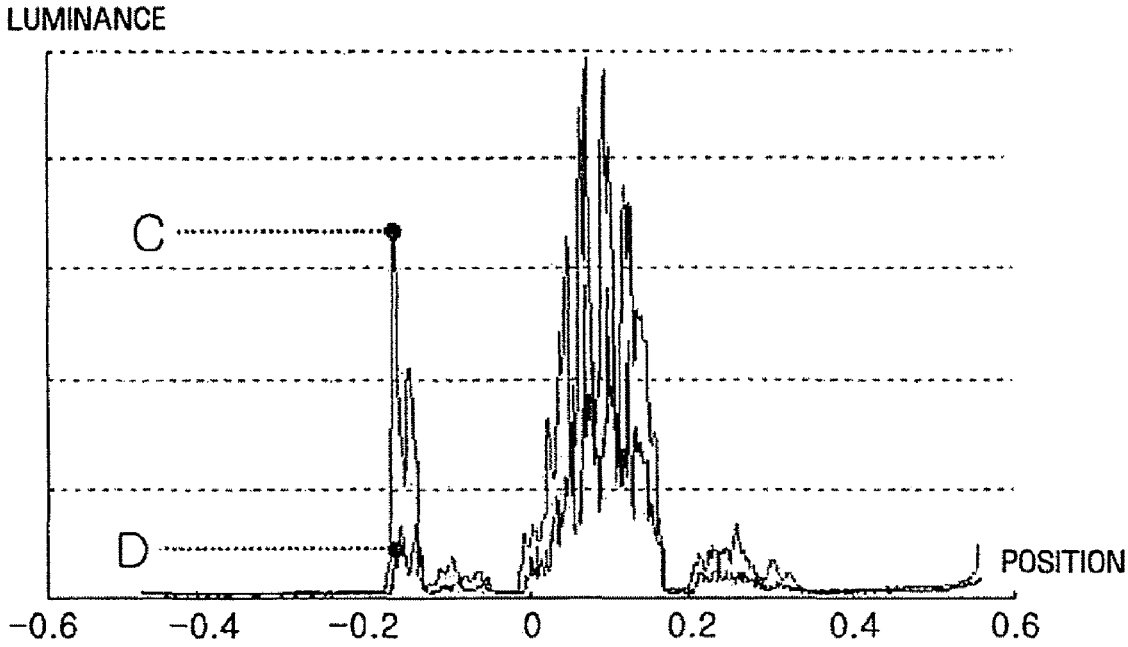

As described above, according to a dimming method of an embodiment of the present invention, the pulse width for obtaining the luminance corresponding to the same grayscale in the low grayscale class is larger than the pulse width in the high grayscale class, and thus image distortion can be minimized for the case of displaying an image which is dark on the whole and only a part of which is bright. For example, with reference to FIG. 5, if the grayscale average of the whole image signal input to the liquid crystal display panel 3000 is 70 and the grayscale average of one block is 255, the grayscale average of the whole is classified in the second class corresponding to the second lookup table 20, and the pulse width ratio for obtaining the luminance corresponding to the grayscale value of 255 in the second lookup table 20 is about 85%. By contrast, if the grayscale average of the whole image signal input to the liquid crystal display panel 3000 is 250 and the grayscale average of one block is 255, the grayscale average of the whole is classified in the fifth class corresponding to the fifth lookup table 50, and the pulse width ratio for obtaining the luminance corresponding to the grayscale value 255 in the fifth lookup table 50 is about 50%. Accordingly, even if the images of the blocks to be displayed have the same grayscale, the pulse widths for obtaining the corresponding luminance may differ in accordance with the grayscale classes of the neighboring blocks, and the pulse width ratio in the low grayscale class is larger than that in the high grayscale class. Accordingly, even if the image is dark on the whole, and only a part thereof is bright, a high luminance can be obtained, and thus the distortion of the image signal can be minimized. That is, as illustrated in FIG. 6B, in the case of performing the dimming with respect to an image, which is dark on the whole and only a part of which is bright as shown in FIG. 6A, using a plurality of lookup tables according to an embodiment of the present invention C, the luminance of the bright part is increased in comparison to the case of performing the dimming using one lookup table according to the conventional method D. Accordingly, the image distortion can be minimized. Here, FIG. 6B shows luminance curves obtained in the case of performing the dimming according to the conventional method and in the case of performing the dimming according to the method of an embodiment of the present invention.

In an embodiment of the present invention, luminance dimming has been described. However, embodiments of the present invention can be applied to the case where the luminance dimming and a color dimming are simultaneously performed. The liquid crystal display that simultaneously performs luminance dimming and color dimming according to another embodiment of the present invention will be described with reference to the accompanying drawings. In the following description of the present invention, duplicate explanation of the liquid crystal display according to an embodiment of the present invention will be omitted or will be briefly made.

Figure 7:
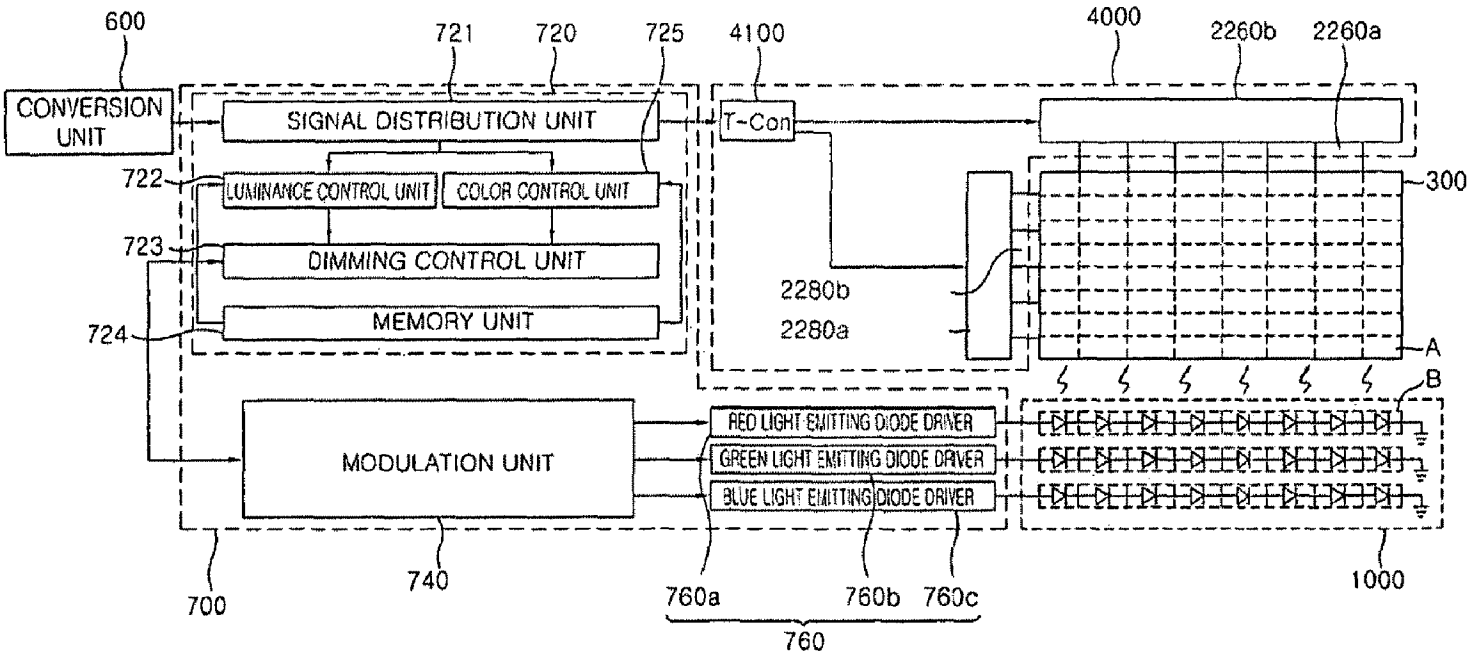
FIG. 7 is a conceptual view of a liquid crystal display according to another embodiment of the present invention.
Figure 8:
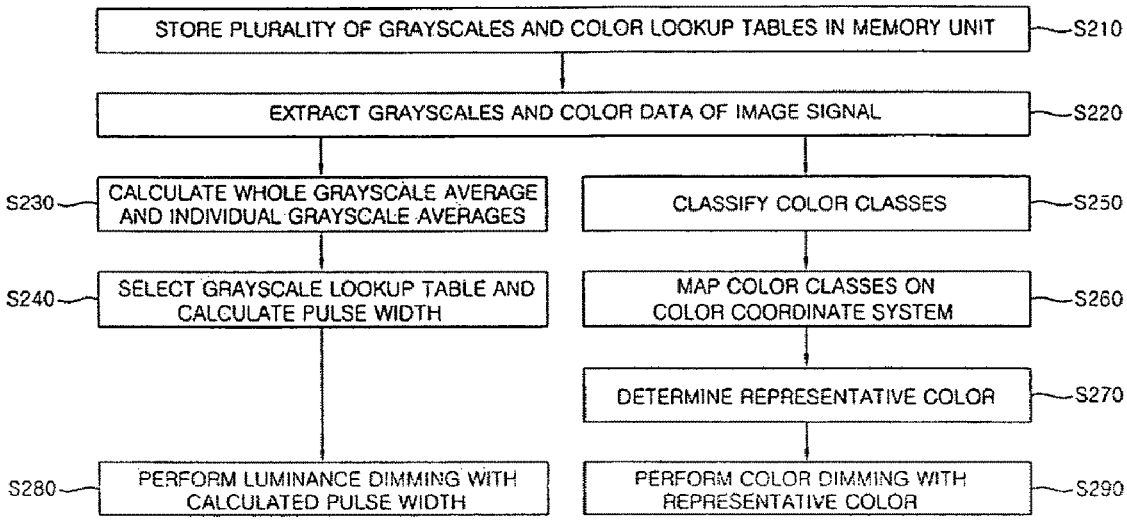
FIG. 8 is a flowchart illustrating a luminance dimming and a color dimming of a liquid crystal display according to another embodiment of the present invention.
Figure 9:
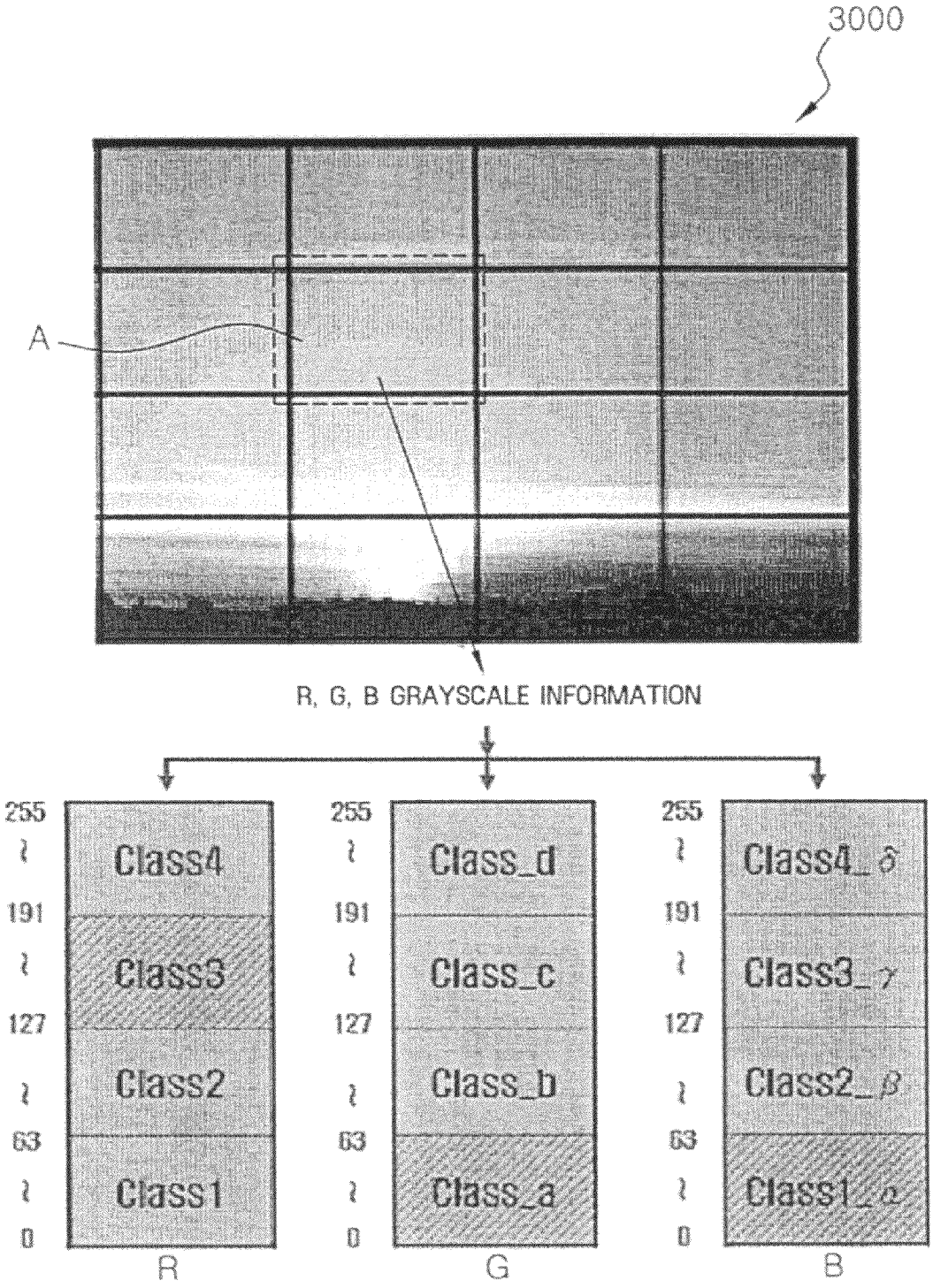
FIG. 9 is a conceptual views illustrating a method of separating color information for the color dimming of a liquid crystal display according another embodiment of the present invention.

FIG. 7 is a conceptual view of a liquid crystal display according to another embodiment of the present invention, and FIG. 8 is a flowchart illustrating a luminance dimming and a color dimming of a liquid crystal display according to another embodiment of the present invention. FIG. 9 is a conceptual view illustrating a method of separating color information for color dimming of a liquid crystal display according another embodiment of the present invention.

A liquid crystal display according to another embodiment of the present invention, as illustrated in FIG. 7, includes a liquid crystal display panel assembly having a liquid crystal display panel 3000 and a liquid crystal display panel driving unit 4000 driving the liquid crystal display panel, and a backlight unit assembly having a backlight unit 1000 supplying light to the liquid crystal display panel 3000 and a backlight unit driving unit 700 driving the liquid crystal display panel. In another embodiment of the present invention, like an embodiment of the present invention as described above, the liquid crystal display panel 300 is divided into a plurality of liquid crystal display blocks A, and also the backlight unit 100 is divided into a plurality of light emitting diode blocks B. Also, the liquid crystal display panel 3000 and the backlight unit 1000 may be driven in the same direction, for example, may be successively driven from upside to downside. In this case, the plurality of light emitting diode blocks B are provided with a plurality of red (R), green (G), and blue (B) light emitting diodes for the color dimming, and the red (R), green (G), and blue (B) light emitting diodes may be individually driven. That is, the red (R), green (G), and blue (B) light emitting diodes are individually driven to provide different colors, respectively. Also, to individually drive the red (R), green (G), and blue (B) light emitting diodes, red (R), green (G), and blue (B) light emitting diode drivers 760*a*, 760*b*, and 760*c* are provided.

The backlight unit driving unit 700 according to another embodiment of the present invention, to simultaneously perform the color dimming and the luminance dimming, includes a signal distribution unit 721, the luminance control unit 722, the dimming control unit 723, the memory unit 724, and a color control unit 725. First, in the memory unit 724, a plurality of luminance lookup tables and a plurality of color lookup tables are stored. The plurality of luminance lookup tables stored in the memory unit 724 are set in the same manner as an embodiment of the present invention as described above. Also, the plurality of color lookup tables stored in the memory unit 724 are set by dividing red (R), green (G), and blue (B) into specified color grayscales, and defining as one color class those regions of color grayscale over which a human cannot distinguish. The signal distribution unit 721 receives the image signal through the conversion unit 600, controls, and applies the grayscale data, the color data, and the timing of the image signal to the timing controller 4100 of the liquid crystal display panel driving unit 4000, the luminance control unit 722, and the color control unit 725. The luminance control unit 722 receives the grayscale data of the image signal from the signal distribution unit 721, and using the received grayscale data, calculates the grayscale average of the whole liquid crystal display panel 3000 and the grayscale averages of the individual liquid crystal display panel blocks A. Also, the luminance control unit 722 selects from the plurality of lookup tables one lookup table corresponding to the class of the grayscale average of the whole, and calculates the pulse width data for obtaining the luminance of the individual grayscale averages from the selected lookup table. Also, the luminance control unit 722 generates and supplies a luminance control signal including the pulse width information to the dimming control unit 723. The color control unit 725 analyzes the color data of the image signal, determines representative colors using the plurality of color lookup tables, and then outputs the corresponding color control signal to the dimming control unit 723. The dimming control unit 723 outputs a dimming control signal for adjusting the power being supplied to the light emitting diode blocks B of the light emitting diode assembly 300 in accordance with the luminance control signal and the color control signal.

A luminance and color dimming method for a liquid crystal display as constructed above according to another embodiment of the present invention will now be described with reference to FIG. 8.

Referring to FIG. 8, a dimming method for a liquid crystal display according to another embodiment of the present invention includes storing a plurality of luminance lookup tables and a plurality of color lookup tables at step S210; extracting color and luminance data of an image signal being applied to the liquid crystal display panel at step S220; calculating the grayscale average of the whole liquid crystal display panel 3000 and grayscale averages of the individual liquid crystal display panel blocks A at step S230; selecting one luminance lookup table from the plurality of luminance lookup tables corresponding to a class to which the grayscale average of the whole liquid crystal display panel 3000 is classified, and calculating pulse width data for obtaining the luminance corresponding to the individual grayscale averages from the selected luminance lookup table at step S240; classifying color classes of the respective color data of the liquid crystal display panel blocks A at step S250; mapping the color classes of the liquid crystal display panel blocks A to a color coordinate system at step S260; determining the representative colors of the liquid crystal display panel blocks A at step S270; performing a luminance dimming by adjusting the power with the calculated pulse width at step S280; and adjusting the colors of the light emitting diode blocks with the representative colors at step S290. In this case, steps S230 and S240 are successively performed by the luminance control unit, and steps S250, S260, and S270 are successively performed by the color control unit. However, the operation of the luminance control unit and the operation of the color control unit may be simultaneously performed. Of course, the operation of the luminance control unit and the operation of the color control unit may also be successively performed.

Hereinafter, the luminance and color dimming method for a liquid crystal display according to another embodiment of the present invention will be described in more detail. Since the luminance dimming method has been described with reference to FIG. 3, the color dimming method will be described.

S210: A plurality of luminance lookup tables and a plurality of color lookup tables are stored in the memory unit 724. To set the plurality of color lookup tables, as illustrated in FIG. 9, the whole grayscale is divided into a plurality of color classes in accordance with gamma curve characteristics of the liquid crystal display panel 3000 for each color. Unlike luminance, it is difficult for a human to distinguish between similar colors. Accordingly, in an embodiment of the present invention, red (R), green (G), and blue (B) are classified into specified color grayscales, for example, 256 color grayscales, and the color grayscales of neighboring regions, between which a human cannot distinguish, among the respective color grayscales are defined as one color class. In an embodiment of the present invention, as illustrated in FIG. 9, 256 color grayscales are tied into four color classes each of red, green, and blue, based on the same visibility or similar color grayscales. That is, respective color grayscales of red, green, and blue classes are classified into four color classes of grayscale values 63, 127, 191, and 255. In an embodiment of the present invention, although red (R), green (G), and blue (B) are respectively divided into four color classes: Class1~Class4, Class_a Class_d, and Class_α~Class_δ, respective color classes having similar visibilities or a same color range can be defined as one region, and thus the number of color classes of the respective colors may vary. Specifically, the numbers of color classes for the respective colors may differ from each other, and the sizes of the divided color classes may differ in accordance with the color grayscales. Also, information on such color classes, i.e., color lookup tables, may be pre-stored in the memory unit 724.

S220: After the plurality of luminance lookup tables and the plurality of color lookup tables are stored in the memory unit 724, the signal distribution unit 721 receives the image signal input through the conversion unit 600, extracts and applies the grayscale data and color data of the image signal to the luminance control unit 722 and the color control unit 725.

S230: The luminance control unit 722 calculates the grayscale average of the whole liquid crystal display panel 3000 and the grayscale averages of the individual liquid crystal display panel blocks A using the grayscale data of the image signal input through the signal distribution unit 721.

S240: The luminance control unit 722 selects from the plurality of lookup tables stored in the memory unit 724 one lookup table of a class corresponding to the grayscale average of the whole liquid crystal display panel 3000, and calculates the pulse width data for obtaining the luminance corresponding to the luminance average of the individual liquid crystal display panel blocks A in the selected lookup table. Then, the luminance control unit 722 generates and applies a luminance control signal including the pulse width information to the dimming control unit 723.

S250: The color control unit 725 classifies the color classes by comparing the color data of the liquid crystal display panel blocks A with the color lookup tables stored in the memory unit 724. For example, if the red (R) grayscale value among the red (R), green (G), and blue (B) color data extracted as shown in FIG. 9 is between the grayscale value 127 and the grayscale value 191, it is classified as the red color class Class3. Similarly, if the green (G) grayscale value is between the grayscale value 0 and the grayscale value 63, it is classified as the green color class Class_a. Similarly, if the blue (B) grayscale value is between the grayscale value 0 and the grayscale value 63, it is classified as the blue color class Class_α. Accordingly, the corresponding pixel is classified as the color class Class_3aα. That is, in the case where the respective pixel data have neighboring color grayscales in a specified range, the pixel data are classified as the same color class.

S260: The classified color classes of the liquid crystal display panel blocks A are mapped to a color coordinate system in which color regions are predefined. For example, the color classes of the liquid crystal display panel blocks A can be mapped to the corresponding color class regions in the CIE 1976 UCS color coordinate system. In this case, the color regions of the color coordinate system having similar color grayscales are defined as one color region, and the color coordinate system may include a plurality of such color regions. Also, the color regions are arranged in a table, and the color coordinate system lookup table having the plurality of color regions can be stored in the memory unit 724 in the same manner as the color lookup table. The step of classifying the red (R), green (G), and blue (B) pixel data input to the liquid crystal display panel blocks A into color classes in accordance with the respective color grayscales and then mapping onto the color coordinates is exemplary and non-limiting. According to another embodiment of the invention, the color class classifying step may be omitted, and the color data may be directly mapped onto the color coordinates. In this case, the color regions of the color coordinate system having similar visibilities or the same color grayscale can be defined as one color region.

S270: The color region of the color coordinate system having most values among the color classes mapped onto the color coordinate system is selected as a representative color. The selection of a representative color by classifying the red (R), green (G), and blue (B) pixel data input to the liquid crystal display panel blocks A into color classes in accordance with the respective color grayscales and then mapping the color classes onto the color coordinates is exemplary and non-limiting. According to other embodiments of the invention, the representative color may be selected by mapping one color class having the most values among the color classes on the color coordinate system.

S280: The dimming control unit 723 outputs a dimming control signal for controlling the power of the light emitting diode blocks B of the light emitting diode assembly 300 in accordance with the luminance control signal input from the luminance control unit 722. In accordance with the dimming control signal, the modulation unit 740 and the light emitting diode driver 760 adjust the pulse width of the power being supplied from the power supply unit, and apply the adjusted power to the light emitting diode blocks B of the light emitting diode block assembly 300. Accordingly, luminance dimming is performed.

S290: The color control signal for the representative color is applied to the dimming control unit 273, and the dimming control unit 273 adjusts the color of the light emitting diode blocks B where the color of the light emitting diode blocks B becomes similar or equal to the representative color of the liquid crystal display panel blocks A. Accordingly, color dimming is performed.

As described above, according to exemplary embodiments of the present invention, a liquid crystal display panel is divided into a plurality of liquid crystal display panel blocks, and the plurality of liquid crystal display panel blocks are classified into a plurality of classes in accordance with the grayscales of the non-selected blocks of the liquid crystal display panel blocks. Then, the grayscales of the selected blocks are changed for each class, and the pulse width data for obtaining the luminance corresponding to the changed grayscales are set as a plurality of lookup tables. Then, one of the plurality of lookup tables is selected in accordance with the grayscale average of the whole liquid crystal display panel, the pulse width data for obtaining the corresponding luminance are calculated in accordance with the grayscale averages of the individual liquid crystal display panel blocks in the selected lookup table, and the dimming is performed by adjusting the power being applied to the light emitting diode blocks using the calculated pulse width data.

If an image, which is dark on the whole and only a part of which is bright, is displayed through the above-described dimming, power is applied with a wider pulse width at the same grayscale, and thus the image can be displayed with a desired luminance to minimize the image distortion and improve display quality.

Although exemplary embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A backlight unit assembly comprising:

a light emitting diode assembly including a plurality of light emitting diode blocks; and a backlight unit driving unit for dividing an image signal into a plurality of blocks, classifying each block into one of a plurality of grayscale classes based on grayscale values of each said block, calculating a whole grayscale average from the image signal and a plurality of individual grayscale averages from each block of the image signal, selecting one of a plurality of lookup tables, each said lookup table having luminance data for adjusting luminance of a light emitting diode block corresponding to one of the grayscale classes in accordance with the whole grayscale average, and adjusting luminance of the light emitting diode blocks in accordance with the luminance data in the selected lookup table, wherein the backlight unit driving unit comprises:

a memory for storing the plurality of lookup tables;

a luminance control unit for calculating the whole grayscale average and the plurality of individual grayscale averages from the image signal, selecting one of the plurality of lookup tables in accordance with the whole grayscale average, and calculating the data for obtaining the luminance corresponding to the individual grayscale averages in the selected lookup table; and a dimming control unit for controlling the luminance of the light emitting diode blocks in accordance with the data calculated by the luminance control unit.

2. The backlight unit of claim 1, wherein the light emitting diode block comprises a plurality of light emitting diodes.

3. The backlight unit of claim 1, wherein the image signal is divided into blocks corresponding to the light emitting diode blocks, and the individual grayscale averages are obtained by calculating the grayscale averages of the individual image signal blocks.

4. The backlight unit of claim 1, wherein the plurality of lookup tables are constructed in accordance with grayscale classes, and the respective lookup tables store the data for adjusting the luminance corresponding to grayscale changes in the respective grayscale classes.

5. The backlight unit of claim 4, wherein the data is pulse width data for adjusting the luminance of the light emitting diode blocks.

6. The backlight unit of claim 1, wherein the backlight unit driving unit comprises a field-programmable gate array (FPGA), and the FPGA includes the luminance control unit and the dimming control unit.

7. The backlight unit of claim 1, wherein the backlight unit driving unit further comprises a color control unit for determining representative colors of the light emitting diode blocks.

8. The backlight unit of claim 1, wherein the memory comprises:

a plurality of color lookup tables for a plurality of color classes including color grayscales having similar visibilities; and a color coordinate lookup table for a plurality of color regions including similar visibilities in a color coordinate system.

9. The backlight unit of claim 8, wherein the color control unit selects as a representative color a color region onto which most color classes of the image signal are mapped, and selects the representative color as the color of the light emitting diode block region.

10. A liquid crystal display comprising:

a liquid crystal display panel for displaying an image, said liquid crystal display panel comprising a plurality of liquid crystal display panel blocks;

a liquid crystal display panel driving unit for driving the liquid crystal display panel;

a light emitting diode assembly including a plurality of light emitting diode blocks for providing light to the liquid crystal display panel; and a backlight unit driving unit for dividing an image signal into a plurality of blocks, classifying each block into one of a plurality of grayscale classes based on grayscale values of each said block, calculating a whole grayscale average from the image signal and a plurality of individual grayscale averages from each block of the image signal, selecting one of a plurality of lookup tables, each said lookup table having luminance data for adjusting luminance of a light emitting diode block corresponding to one of the grayscale classes in accordance with the whole grayscale average, and adjusting luminance of the light emitting diode blocks in accordance with the luminance data in the selected lookup table, wherein the liquid crystal display panel blocks are divided into selected blocks and non-selected blocks, and wherein the lookup tables are provided with luminance data for each of the plurality of grayscale classes in accordance with grayscales of the non-selected blocks, changing grayscales of the selected blocks for the respective grayscale classes, and obtaining the luminance corresponding to the changed grayscales.

11. The liquid crystal display of claim 10, wherein each light emitting diode block comprises a plurality of light emitting diodes.

12. The liquid crystal display of claim 10, wherein the light emitting diode blocks are provided in positions corresponding to the liquid crystal display panel blocks, respectively.

13. The liquid crystal display of claim 10, wherein the backlight unit driving unit comprises:

a memory for storing the plurality of lookup tables having luminance data for each of the plurality of grayscale classes in accordance with grayscales of the non-selected blocks among the liquid crystal display panel blocks, changing grayscales of the selected blocks for the respective grayscale classes, and obtaining the luminance corresponding to the changed grayscales;

a luminance control unit for calculating the whole grayscale average and the plurality of individual grayscale averages from the image signal, selecting any one of the plurality of lookup tables in accordance with the whole grayscale average, and calculating the data for adjusting the luminance corresponding to the individual grayscale averages in the selected lookup table; and a dimming control unit for controlling the luminance of the light emitting diode blocks in accordance with the data calculated by the luminance control unit.

14. The liquid crystal display of claim 13, wherein the backlight unit driving unit further comprises a color control unit for selecting representative colors of the light emitting diode blocks.

15. The liquid crystal display of claim 14, wherein the memory comprises a plurality of color lookup tables having a plurality of color classes including color grayscales having similar visibilities; and a color coordinate lookup table including a plurality of color regions having similar visibilities in a color coordinate system.

16. A dimming method for a liquid crystal display, comprising:

dividing a liquid crystal display panel block into selected blocks and non-selected blocks;

classifying the liquid crystal display panel blocks into a plurality of grayscale classes in accordance with grayscales of the non-selected blocks;

changing grayscales of the selected blocks for the respective grayscale classes, and setting the data for obtaining the luminance corresponding to the changed grayscales;

storing in a plurality of lookup tables luminance data for each grayscale class;

calculating a grayscale average of a whole liquid crystal display panel and grayscale averages of individual liquid crystal display panel blocks with respect to an image signal input to the liquid crystal display panel;

selecting one of the plurality of lookup tables in accordance with the whole grayscale average, and calculating luminance data corresponding to the individual grayscale averages in the selected lookup table; and adjusting and applying a power to a light emitting diode assembly using the calculated data.

17. The dimming method of claim 16, further comprising:

classifying pixels of the respective liquid crystal display panel blocks into color classes;

selecting representative colors of the color classes; and adjusting colors of the light emitting diode blocks in accordance with the representative colors.

18. The dimming method of claim 17, wherein classifying pixels comprises:

setting color lookup tables;

extracting image signals of the respective pixel data of the liquid crystal display panel blocks; and classifying the respective pixels of the liquid crystal display panel blocks into the color classes by comparing the image signals with the color lookup tables.

19. The dimming method of claim 18, wherein setting color lookup tables comprises:

dividing red, green, and blue into specified color grayscales;

assigning similar color grayscales among the color grayscales into identical color classes; and arranging the color classes into tables.

* * * * *